United States Patent [19]

Miki et al.

[11] Patent Number: 4,918,918

[45] Date of Patent: Apr. 24, 1990

[54] VARIABLE DISPLACEMENT PISTON MACHINE

[75] Inventors: Kenichi Miki; Yoichiro Kotake, both of Settsu, Japan

[73] Assignee: Daikin Industries, Ltd., Osaka, Japan

[21] Appl. No.: 251,220

[22] PCT Filed: Nov. 24, 1987

[86] PCT No.: PCT/JP87/00908

§ 371 Date: Jul. 25, 1988

§ 102(e) Date: Jul. 25, 1988

[87] PCT Pub. No.: WO88/03992

PCT Pub. Date: Jun. 2, 1988

[30] Foreign Application Priority Data

Nov. 25, 1986 [JP] Japan ..... 61-281567

[51] Int. Cl.[5] ..... F16D 39/00

[52] U.S. Cl. ..... 60/489; 60/487; 91/475; 91/505

[58] Field of Search ..... 91/475, 499, 504, 505, 91/506; 60/487, 489, 444, 443

[56] References Cited

U.S. PATENT DOCUMENTS

| | | | |
|---|---|---|---|
| 3,190,232 | 6/1965 | Budzich | 91/475 X |
| 4,584,926 | 4/1986 | Beck, Jr. et al. | 91/505 X |
| 4,748,898 | 6/1988 | Hayashi et al. | 60/487 X |
| 4,773,220 | 9/1988 | McFarland | 60/487 |

FOREIGN PATENT DOCUMENTS

| | | |
|---|---|---|
| 49-81903 | 8/1974 | Japan . |
| 58-176480 | 10/1983 | Japan . |

*Primary Examiner*—Edward K. Look

[57] ABSTRACT

A variable displacement piston machine includes a valve plate (3) provided with high-pressure and low-pressure ports (5, 6) to supply and discharge fluid into and from piston chambers (80) in a cylinder block (2) and first and second control ports (P1, P2) disposed in opposite directions between the ports; a pivotable inclined swash plate (4) to adjust the stroke of pistons 1 in the piston chambers (80); and a feedback valve (100) having a second spool actuated by pressure of fluid introduced into an introduction passage (41) with a throttle valve (42), and a first spool (S1) slidably fitted in the second spool (S2). The second spool (S2) causes first and second control ports (P1, P2) to communicate with the high-pressure port (5) and tank passage (53), respectively, thereby causing the pistons (1) to incline the swash plate (4) toward its neutral position while the first spool (S1) connected to the swash plate (4) through a link (8) connects the control ports with the tank passage and high-pressure port, respectively, in a reverse manner to the second spool, to perform a feedback of the inclining motion of the swash plate (4). This machine avoids the use of an operating plunger, accomplishing stable control of the swash plate (4), sets a moving speed of the second spool (S2), i.e. the swash plate (4) arbitrarily by adjusting the throttle valve (42), and prevents shock when the swash plate position is switched.

11 Claims, 5 Drawing Sheets

VARIABLE DISPLACEMENT PISTON MACHINE

FIELD OF TECHNOLOGY

The present invention relates to a variable displacement piston machine, and more particularly, to a variable displacement piston pump or motor with a cylinder block having a plurality of pistons, a valve plate, and a swash plate, wherein the amount of discharge and intake by the piston can be controlled by adjusting the displacement amount of the swash plate.

BACKGROUND OF TECHNOLOGY

Conventionally, adjustment of an angle of inclination of a swash plate in a variable displacement piston machine provided with a valve plate and a cylinder block with a plurality of pistons is done usually as is described in Japanese Patent Publication No. 522/1978. That is, fluid pressure controlled by a pressure compensator valve is caused to act on an operating plunger which is in contact with the swash plate, so that the movement of the operating plunger causes the swash plate to incline. The amount of the discharge and intake of the fluid is adjusted through the alteration in the stroke of the piston caused by the change in the angle of inclination of the swash plate. On the other hand, the present applicant has recently proposed and filed an application for utility model registration (Japanese Utility Model Application No. 61-37882) for an improved variable displacement piston machine that enables the angle of inclination of a swash plate to be adjusted by using pistons in a cylinder block, instead of an operating plunger.

In this improved variable displacement piston machine, as illustrated in FIG. 5, a valve plate has a high-pressure port H, a low-pressure port L and a control port P which is disposed between the high-pressure and low-pressure ports. The control port P is adapted to selectively communicate either to the high-pressure port H or to a tank T by a solenoid controlled valve SV. A proportional reducing valve DV is installed in a passage between the solenoid controlled valve SV and control port P. When the control port P is switched to communicate to the high-pressure port H, pressure on a secondary side of the reducing valve DV, which varies according to the pressure of the high-pressure port H, acts on the control port P and a piston hole A communicating with the control port as the cylinder block rotates, so that the swash plate is pressed towards a neutral position by means of a piston fitted in the piston hole A. Displacement of the swash plate is adjusted depending on the discharge pressure in case of a pump, and the intake pressure in case of a motor, and the discharge quantity of the pump and the intake quantity of the motor are controlled to respective predetermined values relative to the discharge pressure of the pump and the intake pressure of the motor. Also, when the control port P is selectively connected to the tank T, the swash plate is made to return to its maximum angle of inclination by the action of a return spring (not shown in the drawing).

In regulating the angle of inclination of the swash plate in the improved variable displacement piston machine, however, there is a drawback that because the cylinder block has an odd number (nine normally) of piston holes A, an inclining moment to act on the swash plate through the pistons fitted in these piston holes A varies due to the change of positions of the piston holes made while the cylinder block is rotating. The variation in the inclining moment makes the swash plate unsteady and makes the adjustment of the angle of inclination insecure, which adversely affects accurate control of the discharge and intake. Furthermore, as the proportional reducing valve DV is used in order to switch the solenoid controlled valve SV for returning the swash plate to the position of maximum angle of inclination from the neutral position, and vice versa, the speed at which the position of the swash plate is changed can be made somewhat slow depending on a selected reduction rate, compared with a case that the reducing valve is not provided. As a result, however, force to press the swash plate decreases in proportion to the pressure reduction rate selected, and this force becomes too small to overcome the change in the inclining moment. As a result, the unsteadiness or sway of the swash plate cannot be eliminated completely. Decreasing of the pressure reduction rate, however, causes the swash plate to change its position so quickly that a shock occurs.

Accordingly, the object of the present invention is to provide a variable displacement piston machine that prevents the sway of the swash plate due to the change in the inclining moment to realize stable control of the angle of inclination of the swash plate and that enables the moving speed of the swash plate to be controlled as desired through an operation carried out by an external device to eliminate the shock which occurs when the position of the swash plate is changed.

DISCLOSURE OF THE INVENTION

The present invention consists of a variable displacement piston machine comprising a valve plate which is fixed to a housing and provided with a high-pressure port, a low-pressure port, and first and second control ports and located in opposite positions between both the ports; a cylinder block which is rotatably mounted and includes a plurality of piston chambers regularly spaced each other in the circumferential direction and extending in the axial direction, and pistons reciprocating in the respective piston chamber, one end of the cylinder block being in slidable contact with the valve plate so that the piston chambers communicate with the high-pressure port, first control port, low-pressure port and the second control port as the cylinder block rotates; a swash plate inclinably mounted to the other end of the cylinder block for adjusting the stroke of the pistons; a feedback valve for performing a feedback control of the inclining motion of the swash plate, wherein first and second spools engaged with each other are fitted in a valve chamber provided in a main body in such a manner that the first and second spools can move back and forth, the second spool is pressed toward an end of the valve chamber by a spring, while the first spool is connected to the swash plate through a connecting member, the second spool is moved against the force of the spring by the pressure of fluid introduced from an introduction passage open to the valve chamber and connects a first control passage communicating with the first control port selectively either to a high-pressure passage communicating with the high-pressure port or to a tank passage and at the same time connects a second control passage communicating with the second control port selectively either to the tank passage or the high-pressure passage, while the first spool connects the first control passage selectively either to the tank passage or to the high-pressure passage, and the second control passage either to the high-pressure passage or to the tank passage, in accordance with an inclining motion of the swash plate and shifts the second spool with the aid of the pressure of fluid introduced into the introduction passage so as to diminish the inclination of the swash plate, and the inclining motion of the swash plate is controlled by shifting the first spool in accordance with the inclination of the swash plate; and a second-spool speed regulating means provided in the introduction passage for regulating a speed at which the second spool moves.

When the second spool is actuated against the spring by the pressure of the fluid from the introduction passage while the swash plate is at its maximum angle of inclination, the first control passage communicating with the first control port is brought into communication with the high-pressure passage, and the second control passage communicating with the second control port is brought into communication with the tank. Consequently, the pressure of the fluid from the high-pressure port acts on the piston in the piston chamber located at the position of the first control port, and the pressing force of this piston causes the swash plate to be inclined towards a neutral position. At this time, the feedback of the inclining motion of the swash plate to the first spool is effected with the aid of the connecting member and the first spool follows the second spool. During this operation, when the inclining speed of the swash plate towards the neutral position has become higher than the moving speed of the second spool due to the inclining moment, the first control port communicates with the tank passage, and the second control port with the high-pressure passage, respectively. As a result, the pressure of the fluid from the high-pressure port acts on the piston in the piston chamber located at the position of the second control port placed opposite to the first control port, and the pressing force of said piston causes the swash plate incline to the maximum angle of inclination, thereby acting against the unsteadiness or sway of the swash plate caused by the fluctuation of the inclining moment. Thus, the swash plate is actuated by the pressure fluid that is switchable in accordance with the action of the second spool and the feedback action of the swash plate by the first spool which are repeated, and the angle of inclination of the swash plate is adjusted by the pistons passing the first and second control ports. Consequently, the swash plate can be inclined stably or without sway at a speed corresponding to the moving speed of the second spool. Besides, the moving speed of the second spool can be set at will though the adjustment of the second-spool speed regulating means installed in the introduction passage, so that the swash plate can be inclined at any speed and no shock occur when the position of the swash plate is changed.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

PREFERRED EMBODIMENTS OF THE PRESENT INVENTION

The present invention will be described in detail by way of examples with reference to the drawings.

Figure 1:
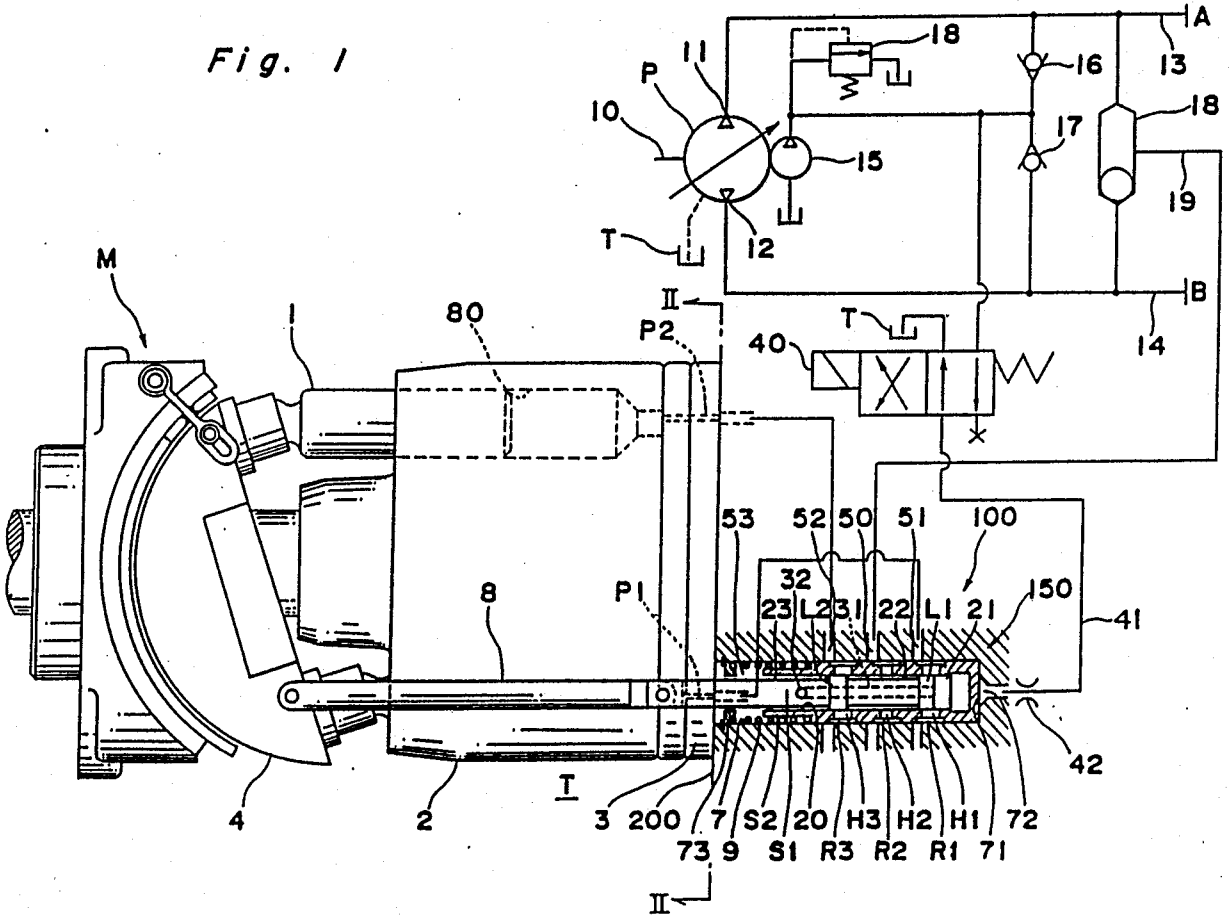
FIG. 1 is a schematic drawing of an embodiment of the present invention showing a variable displacement piston machine applied to a motor.

FIG. 1 shows a hydraulic transmission with a motor M that forms a variable displacement piston machine according to the present invention. This hydraulic transmission has a pump P that is driven externally through a drive shaft 10, inlet and outlet ports 11 and 12 of the pump P, in which the high-pressure side and low-pressure side can be switched reversibly, are respectively communicated through connection passages 13 and 14 to a high-pressure port 5 and a low-pressure port 6 which are disposed in a valve plate 3 of the motor M, respectively, as illustrated in FIG. 2, thereby constituting a closed circuit.

A charge pump 15 is installed on an axis that is the same as that of the drive shaft 10 of the pump P. The charge pump 15 is connected to the connection passages 13 and 14 through respective check valves 16 and 17 so that the oil can be introduced into the inlet or outlet port on the low-pressure side of the pump P. The charge pump 15 is provided with a relief valve 18 to set charge pressure.

The motor M is provided with a rotatable cylinder block 2 in which nine piston chambers which extend in the axial direction and are disposed at equal intervals along the circumferential direction of the cylinder block accommodate therein respective pistons 1, the valve plate 3 fixed to a housing 200 so as to contact one end surface of the cylinder block 2, and a swash plate 4 inclinably mounted at the other end of the cylinder block 2 so as to be able to adjust the movement (stroke) of the pistons 1. The intake of the pistons 1 per one rotation of the cylinder block 2 is increased or decreased by adjusting the angle of inclination of the swash plate 4. At one end of the piston chamber 80 are formed respective holes 1*a*, as shown with a dotted line in FIG. 2.

Figure 2:
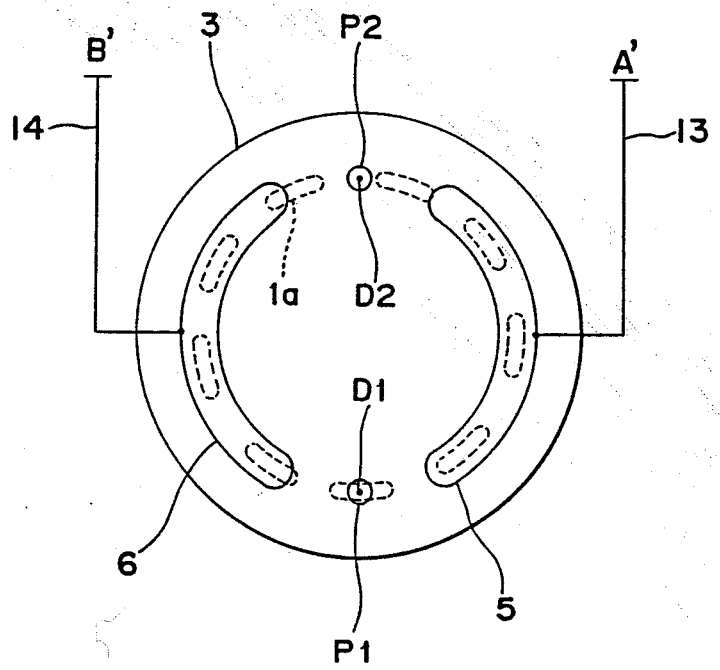
FIG. 2 is a plan view of a valve plate.

Furthermore, the motor M constituting the variable displacement piston machine according the the present invention is provided with a first control port P1 at a position which is located between the high-pressure port 5 and the low-pressure port 6 of the valve plate 3 and is identical to a dead point D1 where the piston 1 is shifted from the high-pressure port 5 to the low-pressure port 6 due to the rotation of the cylinder block 2 as illustrated in FIG. 2. The motor M is also provided with a second control port P2 at a position which is similarly located between the high-pressure port 5 and the low-pressure port 6 and is identical to a dead point D2 where the piston 1 is shifted from the low-pressure port 6 to the high-pressure port 5 due to the rotation of the cylinder block 2, and a feedback valve 100. The construction the details of which will be described in the following.

As shown in FIG. 1, a valve chamber 7 having a closed end surface 71 and communicating with an operation pressure chamber 72 is provided in a main body 150 in the housing 200. The valve chamber 7 accommodates therein a first spool S1 connected to the swash plate 4 through a link 8, a second spool S2 actuated by the charge pressure to be introduced from the charge pump 15 into the operation pressure chamber 72 though a solenoid controlled valve 40, an introduction passage 41 and a throttle valve 42, and a built-in coil spring 9 to apply spring force to the second spool S2 towards the closed end surface 71 of the valve chamber 7.

The first spool S1 has first and second lands L1 and L2, and is slidably installed in a closed internal hole 20 which is provided in the second spool S2 to form a closed chamber 21, an oil chamber 22 and an open chamber 23 between the first spool S1 and the internal hole 20. The second spool S2 has first, second and third annular groove chambers R1, R2 and R3, and first, second and third communication ports H1, H2 and H3 to communicate the annular groove chambers to the internal hole 20 respectively so as to enable the first communication port H1 to selectively communicate either with the closed chamber 21 or with the oil chamber 22 when the first land L1 of the first spool S1 moves, and also to enable the third communication port H3 to selectively communicate either with the oil chamber 22 or with the open chamber 23 as the second land L2 of the first spool S1 moves. Besides, a spring receiver 73 to receive the coil spring 9 is installed on the side of the opening of the valve chamber 7.

The housing 200 contains a high-pressure passage 50 facing the annular groove chamber, a first control passage 51 facing the first annular groove chamber R1, a second control passage 52 facing the third annular groove chamber R3, and the tank passage 53 facing the open chamber 23 and communicating with a tank T in the housing 200, the above passages respectively opening to the valve chamber 7.

The high-pressure passage 50 is not only connected to the high-pressure-side outlet port 11 or 12 of the pump P through a passage 19 on the output side of a shuttle valve 18 that is interposed between the communication passages 13 and 14 but also connected to the high-pressure port 5 or the low-pressure port 6 of the valve plate 3 through the passage 19 and the communication passage 13 or 14.

The first control passage 51 is connected to the first control port P1 of the valve plate 3. The first control port P1 can be made to communicate selectively with the tank passage 53 via the closed chamber 21, longitudinal and transverse holes 31 and 32 formed in the first spool S1, and the open chamber 23, and the high-pressure passage 50 by changing the relative position of the spools S1 and S2, that is, the relative position of the first land L1 and the first communication port H1.

The second control passage 52 is connected to the second control port P2 of the valve plate 3. The second control port P2 can be made to communicate selectively with the high-pressure passage 50 and the tank passage 53 passing the open chamber 23 by changing the relative position of the spools S1 and S2, namely, the relative position of the second land L2 and the third communication port H3.

Thus, the feedback control valve 100 enables the first control passage 51 and second control passage 52 to communicate with the high-pressure passage 50 and the tank passage 53, respectively, by the movement of the second spool 2 actuated with the charge pressure introduced into the operation pressure chamber 72. On the other hand, the action of the first spool S1 for the feedback of the inclining motion of the swash plate 4 causes the control passage 51 to communicate with the tank passage 53 and causes the second control passage 52 to communicate with the high-pressure passage 50, respectively.

Figure 3:
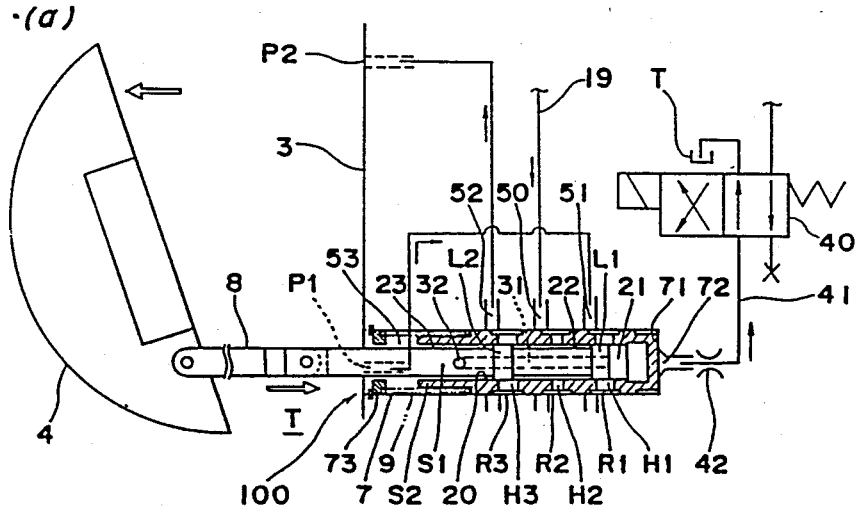
FIGS. 3(*a*), 3(*b*), and 3(*c*) illustrate the actions of the machine of the above-mentioned embodiment.
Figure 3:
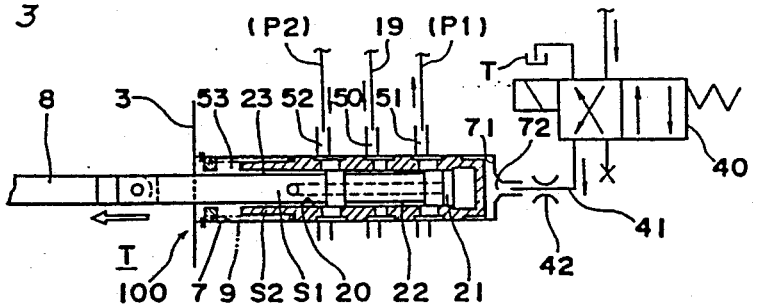
Figure 3:
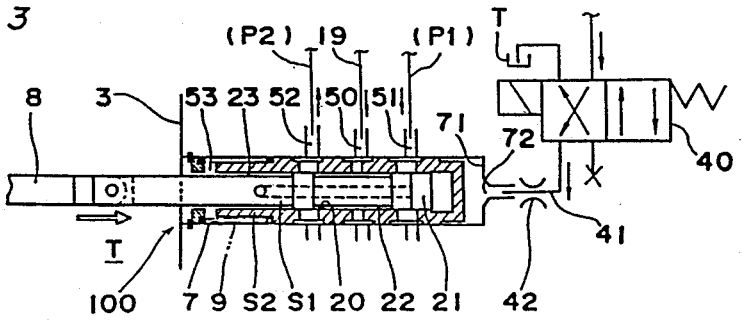

The action of the motor M of the above construction for switching the position of the swash plate 4 from the position of maximum inclination to the neutral position will be described with reference to FIG. 3. In FIG. 3, the arrow of the solid line denotes the flow of the fluid (oil), and the white arrow denotes the direction of the inclining force to act on the swash plate 4.

(a) As shown in FIG. 3(*a*), when the operation pressure chamber 72 of the second spool S2 is opened to the tank T through the solenoid controlled valve 40, the second spool S2 is pressed against the closed end surface 71 of the valve chamber 7 by the coil spring 9 while the first control port P1 is opened to the tank T through the closed chamber 21, longitudinal hole 31, transverse hole 32 and tank passage 53. On the other hand, the second control port P2 communicates with the high-pressure passage 50 through the oil chamber 22, so that the swash plate 4 can be held stably at the position of maximum inclination by the piston which is pushed by the high-pressure fluid acting on the second control port P2.

(b) When the charge pressure is introduced into the operation pressure chamber 72 due to the switchover of the solenoid controlled valve 40, as shown in FIG. 3(*b*), the second spool S2 moves in the valve chamber 7 against the force of the coil spring 9, whereby the first control port P1 in communication with the high-pressure passage 50 through the oil chamber 22 while the second control port P2 is opened to the tank T through the tank passage 53 leading to the open chamber 23. Consequently, the high-pressure fluid acts on the piston located at the first control port P1 (at the dead point D1) so that the pressing force of the piston causes the swash plate 4 to incline to its neutral position.

(c) At this time, the inclining motion of the swash plate 4 is fed back to the first spool S1 through the link 8, and the first spool S1 follows the second spool. At this time, when the inclining speed of the swash plate toward its neutral position becomes higher than the moving speed of the second spool due to the moment of the inclining movement, the first control port P1 is opened to the tank T, while the second control port P2 communicates with the high-pressure passage 50, as shown in FIG. 3(*c*). Consequently, the high-pressure fluid acts on the piston located at the second control port P2 (at the dead point D2), so that the pressing force of this piston causes the swash plate to incline to the position of maximum inclination to resist the swaying motion, of the swash plate 4, caused by a change in the moment of the inclining movement, or inclining moment. (d) Thus, the feedback loop described in the above (b) and (c) will be repeated until the second spool S2 subjected to the charge pressure of the operation pressure chamber 72 stops at the point where the charge pressure is in equilibrium with the force of the coil spring 9, and the swash plate 4 is caused to incline towards the neutral position at a speed corresponding to the moving speed of the second spool S2 actuated by the charge pressure introduced into the operation pressure chamber 72 via the throttle valve 42. Then, as the swash plate 4 inclines toward its neutral position, the stroke of the piston 1 becomes shorter, which reduces the intake by the piston per rotation of the cylinder block 2, whereas the number of times of intake operation per unit hour effected by the piston 1 increases since the amount of fluid (oil) supplied from the pump P is constant, and as a result, the number of revolutions of the motor M increases. Besides, the above feedback loop is maintained regardless of the position at which the second spool S2 stops, so that the swash plate 4 maintains its angle of inclination, and the motor M is rotated at the predetermined number of revolutions per unit hour.

Thus, when the swash plate 4 is inclined in the manner described in the above (b), the swaying motion of the swash plate due to a change in the inclining moment is resisted by an inclining force acting on the swash plate in the direction opposite to that of the swaying motion, as described in the above (c), so that the inclining moment which varies during the inclination of the swash plate is gradually offset by the opposite inclining force that is given from the second control port P2 through the piston. Accordingly, stable control of the swash plate is obtained without permitting the swaying motion. The angle of inclination of the swash plate 4 is adjusted utilizing the piston 1 installed in the cylinder block 2 without requiring a plunger to be operated separately as is required in the conventional system, whereby the simplified construction and adjustment can be realized.

The foregoing description is concerned with the case where the swash plate 4 inclines from the position of maximum inclination towards the neutral position. Also, it is obvious that even in the case where the swash plate inclines from the neutral position towards the position of maximum inclination, the swash plate 4 is caused to incline at a speed corresponding to the moving speed of the second spool S2, and the sway of the swash plate due to the change in the inclining moment can be prevented, so that the swash plate 4 can be controlled stably. Furthermore, in the above embodiment, the pump P and the motor M constituting the variable displacement piston machine are connected to each other in a closed circuit, so that the motor M can be operated in either of the opposite directions.

Also, in the above embodiment, when the throttle valve 42 installed in the introduction passage 41 for introducing the charge pressure into the operation pressure chamber 72 is replaced with a variable throttle valve, the moving speed of the second spool S2 or the inclining speed of the swash plate 4 can be varied at will. Besides, when the throttle valve 42 is replaced with a proportional pressure control valve, the position of the second spool S2 or the angle of inclination of the swash plate can be varied at will. It is also possible to install both.

Furthermore, in the above embodiment, the second spool S2 is moved by use of the charge pressure of the charge pump 15, but alternatively, it may be moved by using a pressure-reduced fluid which can be introduced from a passage such as an outlet-side passage 19 of the shuttle valve through a pressure reducing valve with a constant secondary pressure. In addition, the solenoid controlled valve 40 installed on the introduction passage may be omitted.

Figure 4:
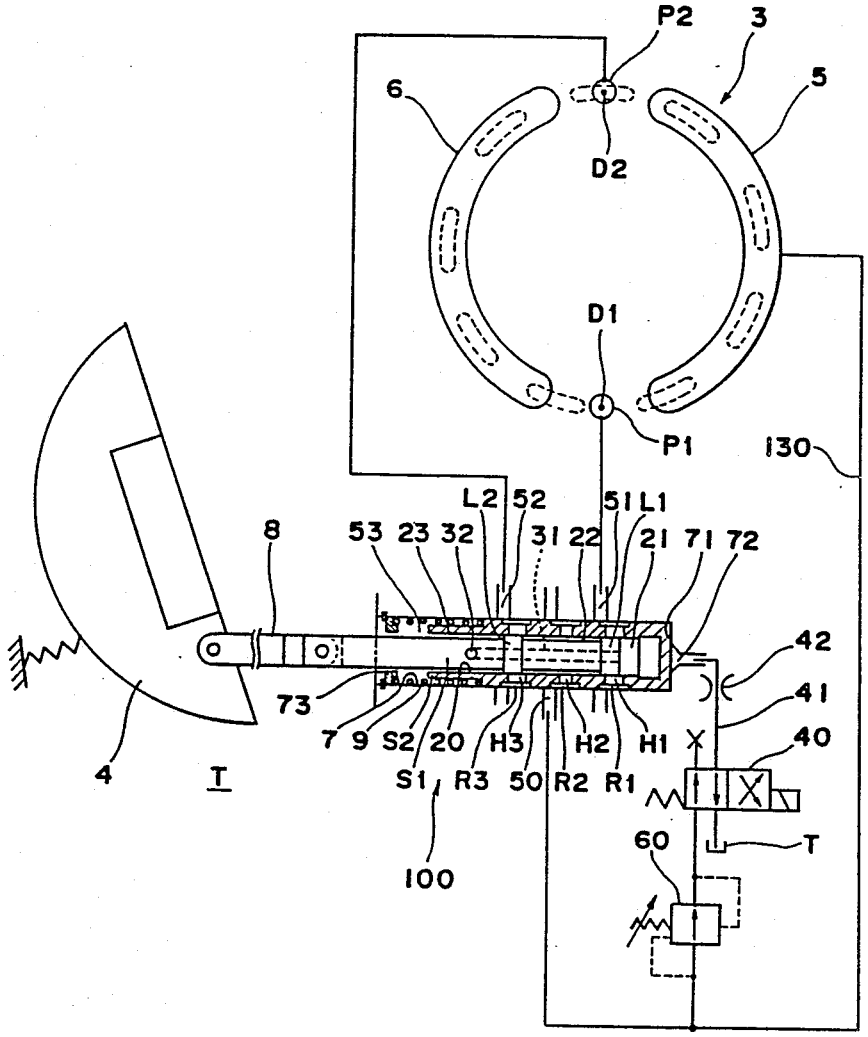
FIG. 4 is a schematic drawing of an embodiment of the present invention showing a variable displacement piston machine applied to a pump.
Figure 5:
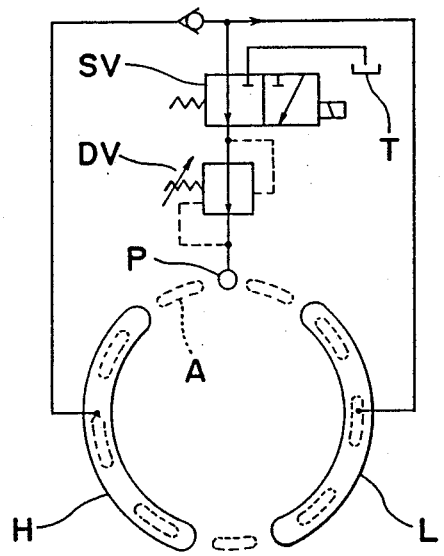
Fig. 5 PRIOR ART
FIG. 5 is a drawing illustrating the prior art.

Furthermore, in the above embodiment, the description is made as to the motor M, but a variable displacement piston machine according to the present invention can also be used as a pump. In such a case, as shown in FIG. 4, a discharge line 130 extending from the high-pressure port 5 of the valve plate 3 is connected to the high-pressure passage 50 of the feedback control valve 100, and pressure which may be reduced by, for example, a pressure reducing valve 60 of constant secondary pressure type may be introduced into the operation pressure chamber 72 from the discharge passage 130.

Besides, in the above embodiment, the second control port P2 and passage related therewith and/or the passage switching means provided in the feedback valve 100 may be omitted. Even in such a case, the inclining motion of the swash plate 4 is controlled by the feedback control through the first control port P1, and so the sway of the swash plate due to the change in the moment of inclining motion can be prevented effectively just like in the case of the above embodiment.

The variable displacement piston machine according to the present invention has the moment of inclining motion varying with the inclining motion of the swash plate 4 offset in sequence by the reverse inclining force given by the second control port P2, and accordingly, the swash plate 4 can be controlled stably without sway. Besides, the angle of inclination of the swash plate 4 is controlled through the repetition of the operation of the second spool S2 and of the feedback control of the swash plate by the first spool S1. The swash plate is, therefore, inclined at a speed corresponding to a motion speed of the second spool S2. For this reason, the inclining speed and the angle of inclination of the swash plate 4 can be set as desired by installing a flow control valve or a pressure control valve in the introduction passage for the pressure fluid to actuate the second spool S2 and adjusting the speed and position of the second spool, thereby eliminating the shock when changing the position of the swash plate. Furthermore, the angle of inclination of the swash plate 4 is adjusted using the piston 1 contained in the cylinder block 2, so that, unlike in the case of the conventional system that requires a separate operating plunger, the adjusting operation can be accomplished more easily, and the construction of the system can be simplified. Thus, the variable displacement piston machine according to the present invention can be applied to a motor and a pump as a fluid pressure machine capable of varying its delivery or displacement easily and accurately.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A variable displacement piston machine comprising:

a valve plate which is fixed to a housing and provided with a high-pressure port, a low-pressure port, and a first control port located between both the ports;

a cylinder block which is rotatably mounted and includes a plurality of piston chambers regularly spaced from each other in the circumferential direction and extending in the axial direction, and pistons reciprocating in the respective piston chamber, one end of the cylinder block being in slidable contact with the valve plate so that the piston chambers communicate with the high-pressure port, first control port and low-pressure port as the cylinder block rotates;

a swash plate inclinably mounted to the other end of the cylinder block for adjusting the stroke of the pistons;

a feedback valve for performing a feedback control of the inclining motion of the swash plate, wherein first and second spools engaged with each other are fitted in a valve chamber provided in a main body in such a manner that the first and second spools can move back and forth, the second spool is pressed toward an end of the valve chamber by a spring while the first spool is connected to the swash plate through a connecting member, the second spool is moved against the force of the spring by the pressure of fluid introduced from an introduction passage open to the valve chamber and connects a first control passage communicating with the first control port selectively either to a high-pressure passage communicating with the high-pressure port or to a tank passage while the first spool connects the first control passage selectively either to the tank passage or to high-pressure passage in accordance with an inclining motion of the swash plate and shifts the second spool with the aid of the pressure of fluid introduced into the introduction passage so as to diminish the inclination of the swash plate, and the inclining motion of the swash plate is controlled by shifting the first spool in accordance with the inclination of the swash plate; and second-spool regulating means provided in the introduction passage for regulating a speed at which the second spool moves.

2. The variable displacement piston machine as set forth in claim 1, wherein the second-spool speed regulating means consists of a flow control valve.

3. The variable displacement piston machine as set forth in claim 1, wherein the second-spool speed regulating means consists of a pressure control valve.

4. The variable displacement piston machine as set forth in claim 1, wherein the second-spool speed regulating means consists of a flow control valve and a pressure control valve.

5. A variable displacement piston machine comprising:

a valve plate which is fixed to a housing and provided with a high-pressure port, a low-pressure port, and first and second control ports located in opposite positions between both the ports;

a cylinder block which is rotatably mounted and includes a plurality of piston chambers regularly spaced from each other in the circumferential direction and extending in the axial direction, and pistons reciprocating in the respective piston chamber, one end of the cylinder block being in slidable contact with the valve plate so that the piston chambers communicate with the high-pressure port, first control port, low-pressure port and the second control port as the cylinder block rotates;

a swash plate inclinably mounted to the other end of the cylinder block for adjusting the stroke of the pistons;

a feedback valve for performing a feedback control of the inclining motion of the swash plate, wherein first and second spools engaged with each other are fitted in a valve chamber provided in a main body in such a manner that the first and second spools can move back and forth, the second spool is pressed toward an end of the valve chamber by a spring, when the first spool is connected to the swash plate through a connecting member, the second spool is moved against the force of the spring by the pressure of fluid introduced from the introduction passage open to the valve chamber and connects a first control passage communicating with the first control port selectively either to a high-pressure passage communicating with the high-pressure port or to a tank passage and at the same time connects a second control passage communicating with the second control port selectively either to the tank passage or the high-pressure passage, while the first spool connects to the first control passage selectively either to the tank passage or to the high-pressure passage, and the second control passage either to the high-pressure passage or to the tank passage, in accordance with an inclining motion of the swash plate and shifts the second spool with the aid of the pressure of fluid introduced into the introduction passage so as to diminish the inclination of the swash plate, and the inclining motion of the swash plate is controlled by shifting the first spool in accordance with the inclination of the swash plate; and second-spool speed regulating means provided in the introduction passage for regulating a spped at which the second spool moves.

6. The variable displacement piston machine as set forth in claim 5, wherein the second-spool speed regulating means consists of a flow control valve.

7. The variable displacement piston machine as set forth in claim 5, wherein the second-spool speed regulating means consists of a pressure control valve.

8. The variable displacement piston machine as set forth in claim 5, wherein the second-spool speed regulating means consists of a flow control valve and a pressure control valve.

9. A variable displacement piston motor comprising:

a valve plate which is fixed to a housing and provided with a high-pressure port, a low-pressure port, and first and second control ports located in opposite positions between both the ports;

a cylinder block which is rotatably mounted and includes a plurality of piston chambers regularly spaced from each other in the circumferential direction and extending in the axial direction, and pistons reciprocating in the respective piston chamber, one end of the cylinder block being in slidable contact with the valve plate so that the piston chambers communicate with the high-pressure port, first control port, low-pressure port and the second control port as the cylinder block rotates;

a swash plate inclinably mounted to the other end of the cylinder block for adjusting the stroke of the pistons;

a feedback valve for performing a feedback control of the inclining motion of the swash plate, wherein first and second spools engaged with each other are fitted in a valve chamber provided in a main body in such a manner that the first and second spools can move back and forth, the second spool is pressed toward an end of the valve chamber by a spring, while the first spool is connected to the swash plate through a connecting member, the second spool is moved against the force of the spring by the pressure of fluid introduced from an introduction passage open to the valve chamber and connects a first control passage communicating with the first control port selectively either to a high-pressure port communicating with the high-pressure port or to a tank passage and at the same time connects a second control passage communicating with the second control port selectively either to the tank passage or the high-pressure passage, while the first spool connects the first control passage selectively either to the tank passage or to the high-pressure passage, and the second control passage either to the high-pressure passage or to the tank passage, in accordance with the inclining motion of the swash plate and shifts the second spool with the aid of the pressure of fluid introduced into the introduction passage so as to diminish the inclination of the swash plate, and the inclining motion of the swash plate is controlled by shifting the first spool in accordance with the inclination of the swash plate; and a flow control valve provided in the introduction passage for regulating a flow rate of pressure fluid; and a directional control valve for connecting the introduction passage selectively either to a pressure source or a tank.

10. A variable displacement piston machine comprising:

a motor having a valve plate which is fixed to a housing and provided with a high-pressure port, a low-pressure port, and first and second control ports located in opposite positions between both the ports; a cylinder block which is rotatably mounted and includes a plurality of piston chambers regularly spaced from each other in the circumferential direction and extending in the axial direction, and pistons reciprocating in the respective piston chamber, one end of the cylinder block being in slidable contact with the valve plate so that the piston chambers communicate with the high-pressure port, first control port, low-pressure port and the second control port as the cylinder block rotates; a swash plate inclinably mounted to the other end of the cylinder block for adjusting the stroke of the pistons; a feedback valve for performing a feedback control of the inclining motion of the swash plate, wherein first and second spools engaged with each other are fitted in a valve chamber provided in a main body in such a manner that the first and second spools can move back and forth, the second spool is pressed toward an end of the valve chamber by a spring, while the first spool is connected to the swash plate through a connecting member, the second spool is moved against the force of the spring by the pressure of fluid introduced from an introduction passage open to the valve chamber and connects a first control passage communicating with the first control port selectively either to a high-pressure passage communicating with the high-pressure port or to a tank passage and at the same time connects a second control passage communicating with the second control port selectively either to the tank passage or the high-pressure passage, while the first spool connects the first control passage selectively either to the tank passage or to the high-pressure passage, and the second control passage either to the high-pressure passage, in accordance with the inclining motion of the swash plate and shifts the second spool with the aid of the pressure of fluid introduced into the introduction passage so as to diminish the inclination of the swash plate, and the inclining motion of the swash plate is controlled by shifting the first spool in accordance with the inclination of the swash plate; a flow control valve provided in the introduction passage for regulating a flow rate of pressure fluid; and a directional control valve for connecting the introduction passage selectively either to a pressure source or a tank; and a pump including a pair of ports, one port being connected to a connection passage communicating with the high-pressure port and the other port being connected to a connection passage communicating with the low-pressure port.

11. A variable displacement piston pump comprising:

a valve plate which is fixed to a housing and provided with a high-pressure port, a low-pressure port, and first and second control ports located in opposite positions between both the ports;

a cylinder block which is rotatably mounted and includes a plurality of piston chambers regularly spaced from each other in the circumferential direction and extending in the axial direction, and pistons reciprocating in the respective piston chamber, one end of the cylinder block being in slidable contact with the valve plate so that the piston chambers communicate with the high-pressure port, first control port, low-pressure port and the second control port as the cylinder block rotates;

a swash plate inclinably mounted to the other end of the cylinder block for adjusting the stroke of the pistons;

a feedback valve for performing a feedback control of the inclining motion of the swash plate; wherein first and second spools engaged with each other are fitted in a valve chamber provided in a main body in such a manner that the first and second spools can move back and forth, the second spool is pressed toward an end of the valve chamber by a spring, while the first spool is connected to a swash plate through a connecting member, the second spool is moved against the force of the spring by the pressure of fluid introduced from an introduction passage open to the valve chamber and connects a first control passage communicating with the first control port selectively either to a high-pressure passage communicating with the high-pressure port or to a tank passage and at the same time connects a second control passage communicating with the second control port selectively either to the tank passage or the high-pressure passage, while the first spool connects the first control passage selectively either to the tank passage or to the high-pressure passage, and the second control passage either to the high-pressure package or to the tank passage, in accordance with the inclining motion of the swash plate and shifts the second spool with the aid of the pressure of fluid introduced into the introduction passage so as to diminish the inclination of the swash plate, and the inclining motion of the swash plate is controlled by shifting the first spool in accordance with the inclination of the swash plate;

a flow control valve provided in the introduction passage for regulating a flow rate of pressure fluid; and a directional control valve for connecting the introduction passage selectively either to a pressure source or a tank.

* * * * *